US005692242A

United States Patent [19]

Tekerman et al.

[11] Patent Number: 5,692,242

[45] Date of Patent: Dec. 2, 1997

[54] ATHLETIC PRACTICE GLOVES

[76] Inventors: Gregg S. Tekerman, 14920 SW. 88 Terrace, Miami, Fla. 33196; J. Christopher Knecht, 9210 SW. 178 Terrace, Miami, Fla. 33157

[21] Appl. No.: 670,293

[22] Filed: Jun. 26, 1996

[51] Int. Cl.[6] ..... A41D 19/00

[52] U.S. Cl. ..... 2/161.1; 2/160; 2/163; 273/26 C; 273/1.5 A; 273/55 R; 473/212

[58] Field of Search ..... 2/159, 160, 161.1, 2/161.2, 161.3, 161.8, 163; 273/26 C, 187.2, 188 R, 55 R, 1.5 A; 482/44, 47, 49; 473/205, 212

[56] References Cited

U.S. PATENT DOCUMENTS

| | | | |
|---|---|---|---|
| 3,096,523 | 7/1963 | Bruchas | 2/159 |
| 3,496,573 | 2/1970 | Kuchar et al. | 2/16 |
| 3,581,312 | 6/1971 | Nickels | 2/20 |
| 3,606,614 | 9/1971 | Dimitroff | 2/159 |
| 3,944,220 | 3/1976 | Fasano | 2/159 |
| 4,051,553 | 10/1977 | Howard | 2/161.2 |
| 4,488,726 | 12/1984 | Murray | 2/161.2 |
| 4,598,429 | 7/1986 | Mulvaney | 2/161.1 |
| 4,675,914 | 6/1987 | Mitchell | 2/159 |
| 4,681,012 | 7/1987 | Stelma et al. | 2/160 |
| 4,694,508 | 9/1987 | Iriyama et al. | 2/160 |
| 5,453,064 | 9/1995 | Williams, Jr. | 2/161.1 |
| 5,456,650 | 10/1995 | Williams, Jr. et al. | 2/161.2 |
| 5,527,244 | 6/1996 | Waller et al. | 482/49 |

*Primary Examiner*—Michael A. Neas
*Attorney, Agent, or Firm*—Harold C. Knecht, III

[57] ABSTRACT

The present invention is an apparatus and method, for improving the ability of a person to handle a piece of sports equipment, which uses one or more gloves operatively adapted to make each hand wearing a glove develop a heightened sense of touch and/or improve the person's ability to concentrate on handling the sports equipment, when the sports equipment is handled for a sufficient period of time while wearing the glove. The present invention enables a person to handle the sports equipment with more confidence and authority. The present method includes the steps of providing at least one such glove, wearing the glove on a hand, and handling the sports equipment with the gloved hand until the ability of the person to handle the sports equipment, with the glove removed, is improved. The present apparatus includes at least one glove having a front section with a plurality of digit portions and one or more sensitizing elements operatively adapted for effecting this improved ability to handle the sports equipment.

20 Claims, 3 Drawing Sheets

ATHLETIC PRACTICE GLOVES

FIELD OF THE INVENTION

The present invention is related to athletic equipment, more particularly to an athletic glove for improving a person's ability to grip or otherwise handle a piece of sports equipment and, even more particularly, to one or a pair of gloves for improving a person's ability to catch, throw and/or run with a football.

BACKGROUND OF THE INVENTION

In the early days of American football, the offense was the run and the pass was a gimmick, rarely used. Today, few teams and certainly no professional teams become a champion without an effective passing and running game. To mount a successful passing attack, the quarterback has to throw the football with accuracy and the receivers have to catch the balls that come their way. To prevent the ground game from stalling, the running backs must not only gain the yardage needed but also hang onto the ball. While handling the football, lapses in the player's concentration or focus can cause a quarterback to overthrow a wide open receiver, a receiver to drop a ball thrown right into his hands, and a running back to fumble. Such missed opportunities can mean the difference between victory and defeat. Thus, quarterbacks, receivers and running backs must each remain highly focused while gripping or otherwise handling the football in order to excel at their game.

Hand gloves have been developed for improving the ability of a football player to catch and hold onto a football. These gloves have a front section that covers the face or front of the player's hand and typically includes an outer surface intended to adhere to, and thereby make it easier to grip, a football. The front section of one such receiver glove has an outer surface covered with pliable rubber, for example, in the form of small rubber bumps. Many football receivers and running backs, amateurs as well as professionals, have used these gloves with varying degrees of success. While they may make it easier to grip a football, these gloves also prevent the player from actually touching the ball.

The ability to touch and feel the ball can make the difference between an average player and an exceptional one. For the top players, the football feels comfortable in their hands and is easier to grip or otherwise handle. This feel for the ball enables the best quarterbacks to toss the ball with just the right touch to evade a defender's outstretched grasp and settle into a receiver's hands. With only one hand on the ball, the quarterback's grip greatly affects the accuracy of the thrown ball. In addition, those receivers with a great pair of hands are able to consistently feel the thrown ball being cradled into their hands and maintain their grip, even while being hit the instant the ball is caught. For the great running backs, the ball almost becomes an extension of their hands; they feel naked without it. Having confidence in their ability to throw, catch and hang onto the ball enables the truly great athletes to play with the authority needed to consistently excel in the game.

Therefore, there is a need for a way to improve an average person's, as well as the superstar athlete's, powers of concentration in handling a piece of sports equipment, as well as a need for a way to improve their ability to grip or otherwise handle the sports equipment with greater confidence and authority.

SUMMARY OF THE INVENTION

The present invention satisfies these needs by providing an apparatus and method for improving the ability of a person to handle a piece of sports equipment by providing at least one glove which is operatively adapted, according to the principles of the present invention, to make it difficult for the person to feel and/or handle the sports equipment. The present invention is predicated, at least in part, upon the discovery that each hand wearing a glove according to the principles of the present invention tends to develop a heightened sense of touch or feeling, if the sports equipment is handled for a sufficient period of time while wearing the glove. This period of time may be different for each individual, but in any case, it can be determined by simple trial and error experimentation. Once this heightened sense of touch has developed and the present glove is removed, the sports equipment feels more comfortable and is easier to grip or otherwise handle, with the hand that had been wearing the inventive glove.

It has also been found that by making it more difficult to handle a piece of sports equipment, the present invention can help train the wearer of the glove to focus more on handling the sports equipment, and thereby improve the wearer's powers of concentration. The ability of the present invention to impart a heightened sense of touch to the wearer and/or help improve the wearer's powers of concentration enables the wearer to handle the sports equipment with more confidence and authority.

In one aspect of the present invention, a method is provided which includes the steps of: providing at least one glove which is operatively adapted to inhibit the ability of a hand that is wearing the glove to feel the piece of sports equipment being handled; wearing the glove on the hand; and handling the sports equipment with the gloved hand for a long enough period of time to cause the gloved hand to develop a heightened sense of touch and thereby improve the ability of the hand, with the glove removed, to handle the sports equipment. Before the sport is played, the glove is removed and the sports equipment is handled with the hand that had been wearing the glove.

It may be desirable for the glove provided in the above method of the present invention to be operatively adapted to prevent the gloved hand from feeling the true size of the piece of sports equipment being handled.

In another aspect of the present invention, a method is provided which includes the steps of: providing a glove which is operatively adapted to make it more difficult for (i.e., to inhibit the ability of) a hand wearing the glove to handle a piece of sports equipment; wearing the glove on the hand; and handling the sports equipment with the gloved hand for a sufficient length of time to cause an improvement in the ability of the person to concentrate or focus on handling the sports equipment with the glove removed.

In either of the above methods of the present invention, the step of handling the sports equipment with the gloved hand can involve gripping the sports equipment with the gloved hand. For example, this step may involve gripping a football, a basketball, a baseball, the handle of a baseball bat, the handle of a tennis racket, the shaft of a golf club or a piece of some other sports equipment, with the gloved hand. The step of handling the sports equipment may also involve dribbling and shooting a basketball and serving a volleyball with the gloved hand, to name a few. The present invention is not intended to be limited to the specific examples disclosed herein.

In an additional aspect of the present invention, an apparatus is provided for improving the ability of a person to handle a piece of sports equipment. The apparatus includes one or two gloves, each glove having a front section with a plurality of digit portions and at least one sensitizing element secured to the front section. A single sensitizing element or a plurality of sensitizing elements can be sown, glued, riveted or otherwise secured to the front section of the glove. The one or more sensitizing elements secured to the glove are operatively adapted for substantially inhibiting the ability of the hand that is wearing the glove to feel the piece of sports equipment being handled. In this way, a heightened sense of touch can be developed in the hand wearing the glove, when the sports equipment is handled for a long enough period of time. Once the glove is removed, the hand can develop a sufficiently heightened sense of touch that the ability of the hand to grip or otherwise handle the sports equipment is improved.

The present apparatus can be made to inhibit the ability of the gloved hand to feel the handled sports equipment by making the one or more sensitizing elements sufficiently rigid and thick to cause a hand wearing the glove to feel as if the piece of sports equipment being handled is actually larger than it really is. Satisfactory results have been obtained when the size, rigidity and thickness of each sensitizing element used prevents the fingers and thumb (i.e., the digits) of the hand wearing the glove from fully flexing or curling around the piece of sports equipment being handled. However, the present invention is not intended to be so limited.

It is desirable for at least part of a sensitizing element to be secured to the front section on one or more of the digit portions. Satisfactory results have been obtained by securing at least part of a sensitizing element to the front section of each of the digit portions and to the front section of the palm portion of the glove.

One or more rigid digit protectors can each be secured to the front section of one of the digit portions of the glove to protect one or more selected fingers and/or the thumb of the hand from being jammed. Each digit protector can extend up to the finger tip portion of its corresponding digit portion. It may also be desirable for each digit protector to extend up to and over its corresponding finger tip portion. Each digit protector can be a separate element or an integral part of a sensitizing element.

When two gloves are used, it is desirable in some applications, most notably when catching a football, for each of the gloves to include a target marking formed along the digit portions corresponding to the index finger and thumb. The target marking can be formed using any suitably visible means, for example, paint, strips of colored material, etc., of an easily distinguishable color (e.g., fluorescent).

Accordingly, the present invention provides an apparatus and method for improving an athlete's ability to grip or otherwise handle a piece of sports equipment with more confidence and authority. This includes, for example and not by way of limitation, a football player's ability to handle a football, a rugby player's ability to handle a rugby football, a basketball player's ability to dribble and shoot a basketball, a tennis player's ability to grip the handle of a tennis racket, a baseball player's ability to grip a baseball or a bat, a golfer's ability to grip the shaft of a golf club, etc.

The objectives, features, and advantages of the present invention will become apparent upon consideration of the present specification and the appended drawings.

DETAILED DESCRIPTION OF THE INVENTION

Although the present invention is herein described in terms of specific embodiments, it will be readily apparent to those skilled in this art that various modifications, re-arrangements, and substitutions can be made without departing from the spirit of the invention. The scope of the present invention is thus only limited by the claims appended hereto. For purposes of example only, and not by way of limitation, the following embodiment of the present invention, and modifications thereto, are specifically described with regard to improving the ability of a person to grip and otherwise handle a football with one or both hands.

Figure 1:
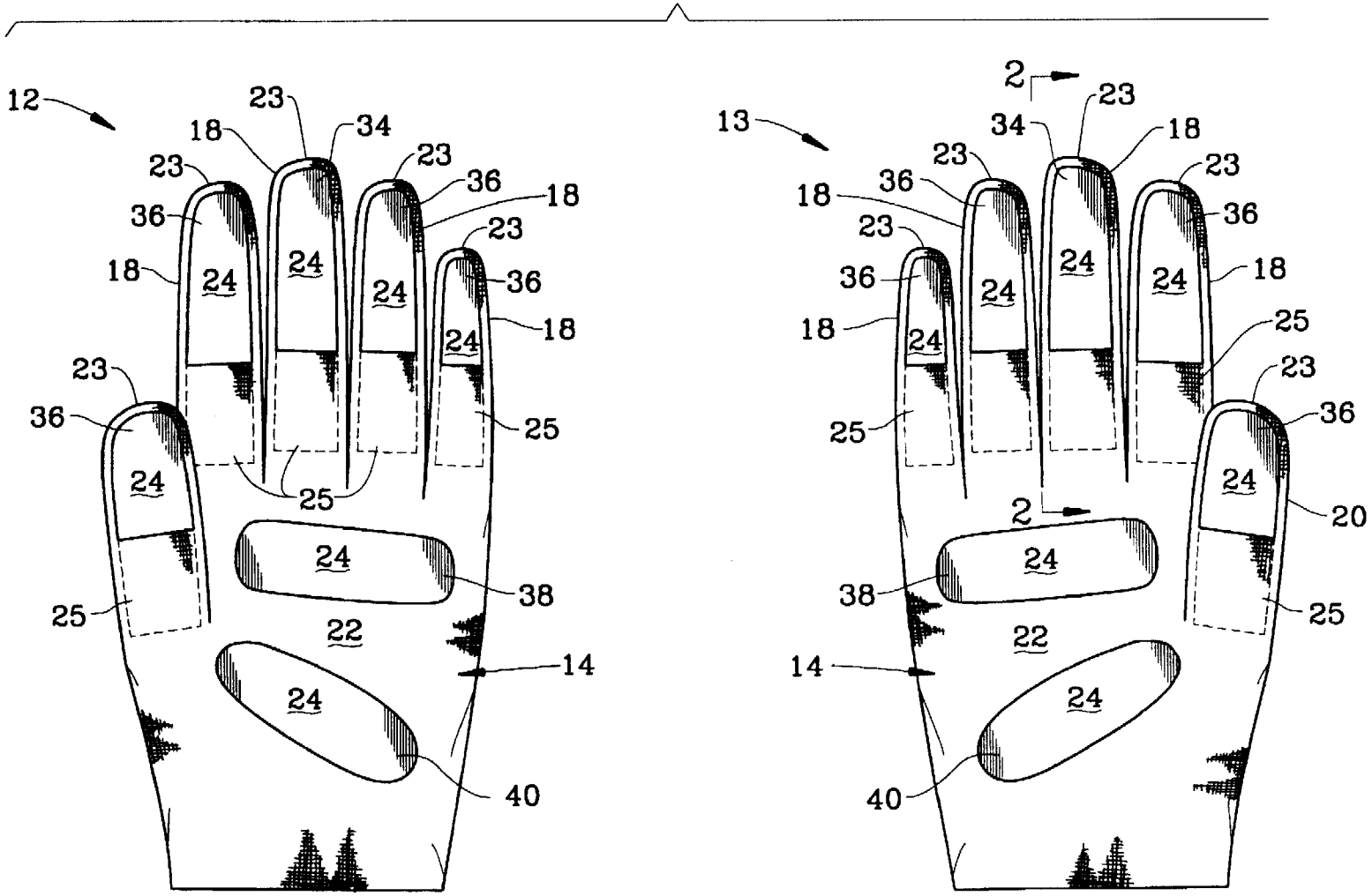
FIG. 1 is a plan view of the front-side of two gloves according to one embodiment of the present apparatus.
Figure 2:
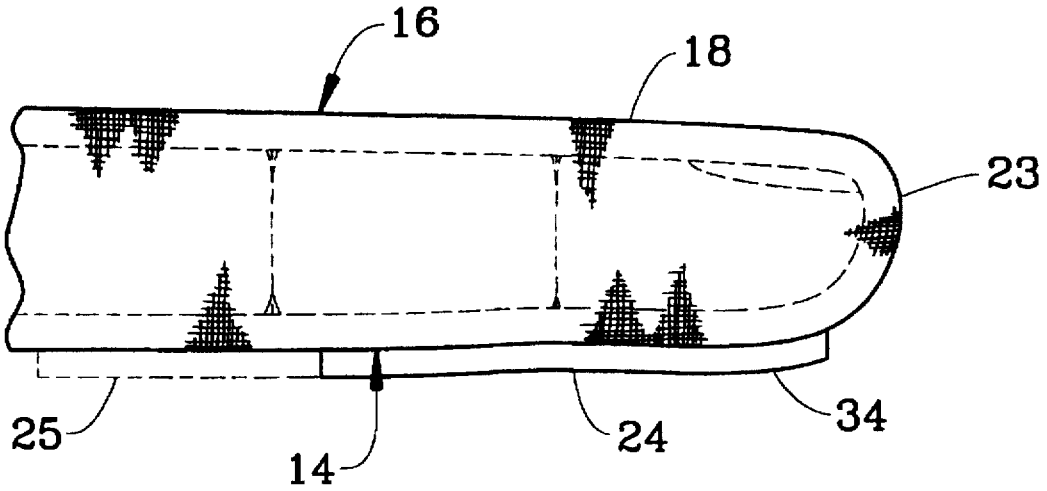
FIG. 2 is a side view taken along line 2—2 of a digit portion of the right-hand glove of the apparatus of FIG. 1.

Referring to FIGS. 1 and 2, one embodiment of an apparatus 10 according to the present invention includes a left-hand glove 12 or a right-hand glove 13. In a modification of this embodiment, the apparatus 10 includes both gloves 12 and 13. Since gloves 12 and 13 are mirror images of each other, the same reference numbers will be used for the same structure on both gloves 12 and 13. Each glove 12 and 13 has a front section 14, a back section 16 (see FIG. 2), five digit portions (i.e., four finger portions 18 and a thumb portion 20) and a palm portion 22. The finger portions 18 and thumb portion 20, of either glove 12 and 13, each have a finger-tip portion 23. Each glove 12 and 13 can be of any suitable style. For example, satisfactory results have been obtained using the gloves manufactured by Neumann, a division of Adams USA, Inc., of Cookeville, Tenn., and generally described a TACKIFIED™ Football Gloves and in particular as ORIGINAL PRO-LINE FOOTBALL RECEIVER GLOVES. Each glove 12 and 13 is adapted to cover at least part, and preferably most, of each finger and the thumb of a player's hands when the gloves 12 and 13 are worn. It is understood that for some applications, it may only be necessary for some of the fingers and the thumb of each hand to be so covered when wearing the present glove.

In the embodiment illustrated, a plurality of sufficiently rigid sensitizing elements 24 are attached to the front section 14 of each glove 12 and 13. Each of the sensitizing elements 24 can be sown, glued, riveted, or otherwise secured to or made a part of the gloves 12 and 13. One sensitizing element 24 is secured along each finger portion 18 and along the thumb portion 20 of each glove 12 and 14. The sensitizing elements 24 on the finger and thumb portions 18 and 20, as shown, can be made shorter so as to allow the fingers of the gloved hand to at least partially curl or flex around the piece of sports equipment being handled, in this embodiment a football. Alternatively, the elements 24 on the finger and thumb portions 18 and 20 can be made longer (as indicated by the phantom lines 25) so as to prevent any curling of the fingers of the gloved hand around the football. The shorter elements 24 on the finger portions 18 may be particularly desirable for those people who would otherwise have a very difficult time catching, gripping or otherwise handling a football while wearing the gloves 12 and 13. The shorter elements 24 can make it easier to handle the football and can help prevent a player from becoming discouraged when the longer elements 25 are used, which can make it more difficult to handle the football.

While the digit portions 18 and 20 of each glove 12 and 13 are shown as fully covering the fingers and thumb of the corresponding hand, it is understood that the apparatus 10 can be modified such that each digit portion 18 and 20, along with its corresponding sensitizing element, covers less than the entire associated digit. It may be desirable for one or more sensitizing elements 24 to be secured to the palm portion 22 of each glove 12 and 13 in addition to, or possibly even instead of, the elements 24 attached to the digit portions 18 and 20.

Instead of being separate and discreet components which are individually secured to the glove, it may be desirable for the sensitizing elements 24 to be in the form of a single component which is sown, glued, riveted or otherwise secured to the front section of its corresponding glove 12 and 13. It may also be desirable for the face of each sensitizing element 24 to be covered with a layer of high friction material such as, for example, textured vinyl and cabretta leather. This layer of high friction material makes it easier for a football to be caught, gripped or otherwise handled while wearing the gloves 12 and 13. Satisfactory results have been obtained when a layer of vinyl, textured with bumps, is used to cover each sensitizing element 24. This feature may be particularly desirable for those people who would otherwise have a very difficult time catching, gripping or otherwise handling a football while wearing the gloves 12 and 13.

For each glove 12 and 13, the corresponding sensitizing elements 24 are operatively adapted to substantially inhibit the ability of the hand wearing the glove to feel, and thereby handle, a football. At the same time, the sensitizing elements 24 still enable the football to be handled by the gloved hand. After a long enough period of time, the hand wearing the glove develops a sufficiently heightened sense of touch and/or the wearer develops greater powers of concentration such that, with the glove removed, the ability of the player to handle the football is improved. The appropriate time period for wearing one or both gloves 12 and 13 may vary per player and can be readily ascertained by simple trial and error experimentation.

A sufficiently heightened sense of touch has been obtained in as little as 10 minutes of catching, throwing or otherwise handling the football while wearing the gloves 12 and 13. Once the gloves 12 and 13 were removed, the football was easier to catch, throw and otherwise handle, due to the heightened sense of touch. After handling the football while wearing the gloves 12 and 13 for extended periods at a time over about a week or more, the player's powers of concentration should improve because the player is forced to focus more on the task at hand (i.e., handling the football). The time it takes to obtain noticeable improvements and the extent of any such improvements will likely vary from player to player.

In addition to the sensitizing elements 24 being disposed between the player's hand and the sports equipment, it may also be desirable to dispose the elements 24 anywhere that sufficiently inhibits the fingers of the hand wearing the glove from curling or flexing around the sports equipment. The sensitizing elements 24 for each glove 12 and 13 can also be formed as a single component, which is secured in place by any of the above or other suitable means. Thus, the present invention is not intended to be limited to any particular type of sensitizing element. The end effect can be used to determine suitability of a particular sensitizing element or group of sensitizing elements.

Figure 3:
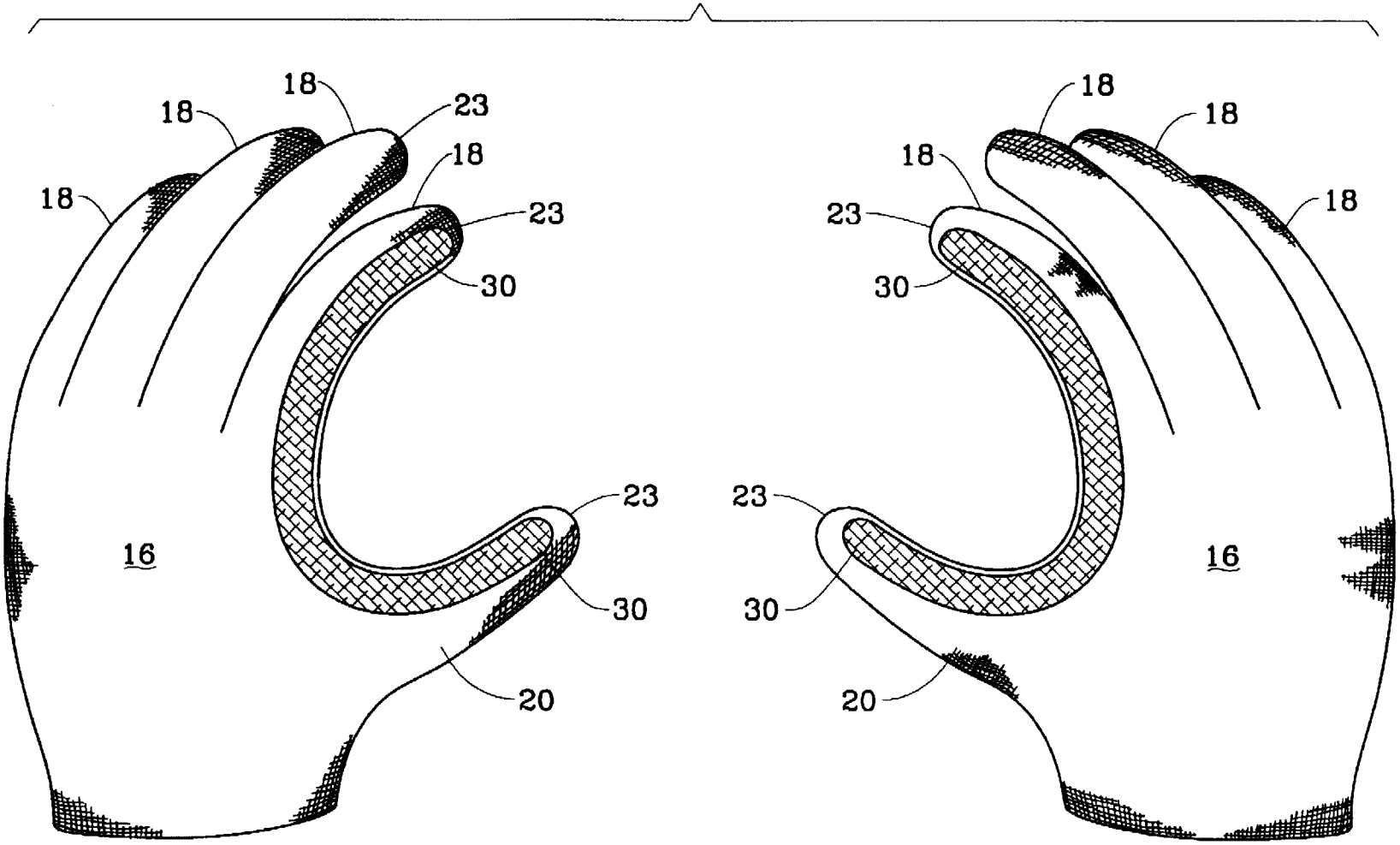
FIG. 3 is a perspective view of the two gloves of FIG. 1 in position to catch a football, with each glove having a target marking according to the present invention.

Referring to FIG. 3, it has been found desirable, when a football is the sports equipment being handled, to mark the surface of each glove 12 and 13 with a target marking 30 along the index finger portion 18 and thumb portion 20 of each glove 12 and 13. When the gloves 12 and 13 are each curved into a cup- or C-shape and brought together in position to, for example, catch the football, each target marking 30 has a generally C-shape and together the two markings 30 form a generally O-shape. Each mark 30 is formed using any suitably visible means, for example, paint, ink, strips of colored material, etc. of an easily distinguishable color. The color used is preferably fluorescent.

Figure 4:
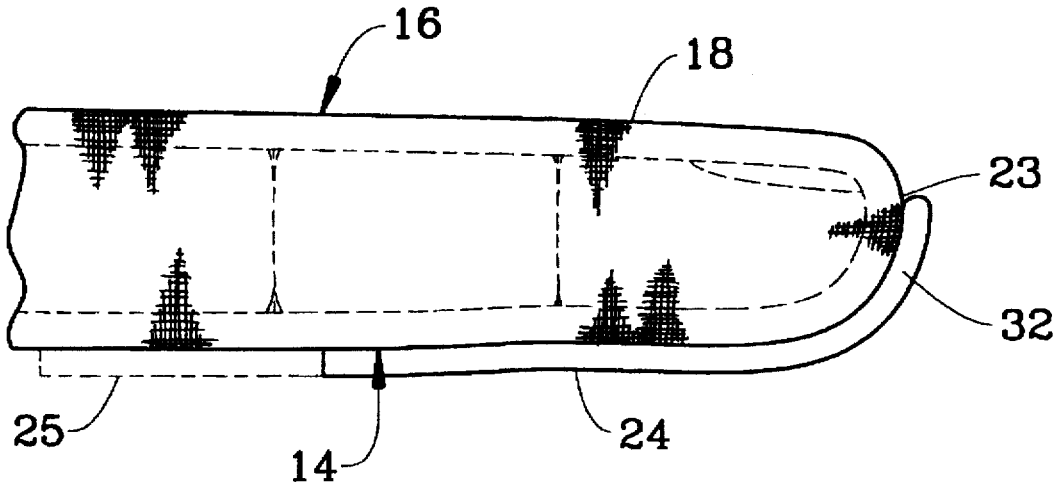
FIG. 4 is a side view, similar to that of FIG. 2, of a digit portion with a digit protector forming an integral part of the sensitizing element attached thereto.

Referring to FIG. 4, each glove 12 and 13 can include one or more digit protectors 32 for protecting one or more selected fingers and/or the thumb of each hand from being jammed, for example, by a thrown football. Each digit protector 32 can be separate from or, as shown, made an integral part of one of the sensitizing elements 24 on the finger portions and thumb portion of each glove 12 and 13. Each digit protector 32 is rigid and extends up to or, as shown, over one of the finger tip portions 23. Each digit protector 32 can be secured to its corresponding glove 12 and 13 in any of the ways described above for the elements 24.

The sensitizing elements 24 are dimensioned and/or sufficiently stiff or rigid to at least limit the ability of the gloved hand to curl or flex around or otherwise feel the football. Satisfactory results have been obtained with sensitizing elements 24 made of thin strips of wood, such as the type used to make tongue depressors, and thin strips of plastic (e.g., plexiglass). Satisfactory results have also been obtained with gloves 12 and 13 which included the specific exemplary elements 24 and 25 described below. These exemplary elements 24 and 25 include a middle digit element 34, four remaining digit elements 36, and two palm elements 38 and 40, each made of plexiglass with a thickness of about 3/32 of an inch and glued at locations on the gloves 12 and 13 generally as shown. The length of each of the exemplary digit elements 34 and 36 listed in Examples #1 and #2 below include the length of a digit protector 32 that extends up to and over its corresponding finger tip portion 23 as shown in FIG. 4.

EXAMPLE #1

(Longer Elements 25)

The middle finger element 34 has an overall length of about 3 inches and the other digit elements 36 have an overall length of about 2 and ½ inches. Each of the elements 34 and 36 have a width of about ¾ of an inch. The palm element 38 at the base of the finger portions 18 (i.e., top of the palm portion 22) has a length of about 2 and ¾ inches and a width of about ⅞ of an inch. The other palm element 40 disposed at an angle across the palm portion 22 has a length of about 2 and ⅜ inches and a width of about 1 and ¼ inches.

EXAMPLE #2

(Shorter Elements 24)

The middle finger element 34 has an overall length of about 2 and ½ inches and the other digit elements 36 have an overall length of about 2 and ⅛ inches. Each of the elements 34 and 36 have a width of about ¾ of an inch. The palm element 38 at the base of the finger portions 18 (i.e., top of the palm portion 22) has a length of about 2 and ¾ inches and a width of about ⅞ of an inch. The other palm element 40 disposed at an angle across the palm portion 22 has a length of about 2 and ⅜ inches and a width of about 1 and ¼ inches.

It is believed that strips of other sufficiently rigid materials, such a metal and composites (e.g., a fiber reinforced plastic), or even semi-rigid to rigid elastomeric materials, such as that used for the side wall of an automobile tire, may also be used to produce satisfactory sensitizing elements 24. It is therefore believed that the degree of necessary rigidity may be varied significantly, for some or all of the elements 24 or 25. For example, the gloves 12 and 13 may work satisfactorily if the sensitizing elements 24 or 25 are resilient enough to flex around the piece of sports equipment to a greater extent and/or made thicker so that each hand wearing a glove is even less likely to feel the piece of sports equipment.

It has been found that by increasing a player's sense of touch, the ability of the player to catch and/or throw a football can be improved. It has been discovered that the sense of touch deprivation that can be developed by catching, throwing, gripping and/or otherwise handling a football while wearing at least one of the gloves 12 and 13, for a sufficient period of time, causes the football player's sense of touch to become hypersensitive. With the gloves 12 and 13 removed, this hypersensitivity has been found to improve the player's ability to grip and/or otherwise handle a football.

It has also been found that by making it more difficult for the player to handle the football, the present invention can enable the player to develop greater powers of concentration. With the one or more gloves removed, such improved concentration can result in a comparable improvement in the ability of the player to handle the football more effectively and with more confidence and authority. In particular, using one or both of the gloves 12 and 13 can improve a receiver's ability to grip and catch the ball, a quarterback's ability to grip and throw the ball, and a running back's ability to grip and hang onto the ball, while running, with more authority and with more confidence that the ball will not be stripped away or otherwise fumbled.

From the above disclosure of the general principles of the present invention and the preceding detailed description, those skilled in this art will readily comprehend the various modifications to which the present invention is susceptible. In addition, while the present invention has mainly been described with regard to handling a football, the present invention is not intended to be so limited. It is understood that the general principles of the present invention are equally applicable to the handling of other types of sports equipment. Therefore, the scope of the invention should be limited only by the following claims and equivalents thereof.

What is claimed is:

1. A method for improving the ability of a person to handle a piece of sports equipment, said method comprising the steps of:

providing at least one glove having a front section with at least one digit portion and at least one sensitizing element secured to the at least one digit portion, the at least one glove being operatively adapted to inhibit the ability of a hand, wearing the glove, to feel the piece of sports equipment being handled;

wearing the glove on the hand, thereby forming a gloved hand;

handling the sports equipment with the gloved hand for a period of time to cause the gloved hand to develop a heightened sense of touch and thereby improve the ability of the hand, with the glove removed, to handle the sports equipment.

2. The method set forth in claim 1, wherein said method includes the steps of:

removing the glove from the gloved hand; and then handling the sports equipment with the hand.

3. The method set forth in claim 1, wherein the step of providing a glove involves providing a glove which is operatively adapted to prevent the gloved hand from feeling the true size of the piece of sports equipment.

4. The method set forth in claim 1, wherein the step of handling the sports equipment with the gloved hand involves gripping the sports equipment with the gloved hand.

5. The method set forth in claim 1, wherein the step of handling the sports equipment with the gloved hand involves at least one of gripping the handle of a baseball bat, gripping the handle of a tennis racket, dribbling a basketball and shooting a basketball with the gloved hand.

6. The method set forth in claim 1, wherein the step of handling the sports equipment with the gloved hand involves gripping a football.

7. A method for improving the ability of a person to handle a piece of sports equipment, said method comprising the steps of:

providing at least one glove having a front section with at least one digit portion and at least one sensitizing element secured to the at least one digit portion, the at least one glove being operatively adapted to inhibit the ability of a hand, wearing the glove, to handle the piece of sports equipment being handled;

wearing the glove on the hand, thereby forming a gloved hand;

handling the sports equipment with the gloved hand for a period of time sufficient to cause an improvement in the ability of the person to concentrate on handling the sports equipment.

8. The method set forth in claim 7, wherein the step of handling the sports equipment with the gloved hand involves gripping a football.

9. The method set forth in claim 7, wherein the step of handling the sports equipment with the gloved hand involves at least one of gripping the handle of a baseball bat, gripping the handle of a tennis racket, dribbling a basketball and shooting a basketball with the gloved hand.

10. An apparatus for improving the ability of a person to handle a piece of sports equipment, said apparatus comprising:

at least one glove having a front section with a plurality of digit portions and a palm portion; and at least one sensitizing element secured to said palm portion and to at least one of said digit portions, said at least one sensitizing element being sufficiently rigid and thick to inhibit the ability of the hand wearing said glove to handle the sports equipment being handled, and when the sports equipment is handled by the hand wearing said glove for a long enough period of time, the person develops at least one of a sufficiently heightened sense of touch in the hand wearing said glove and sufficiently greater powers of concentration so that the ability of the person to handle the sports equipment with said glove removed is improved.

11. The apparatus set forth in claim 10, wherein said apparatus further comprises a plurality of rigid digit protectors, said glove has a plurality of finger tip portions, and each of said plurality of digit protectors is secured to one of said digit portions and extends up to one of said finger tip portions.

12. The apparatus set forth in claim 11, wherein at least one of said digit protectors extends up to and over one of said finger tip portions.

13. The apparatus set forth in claim 10, wherein said at least one sensitizing element is a plurality of sensitizing elements, and at least one of said sensitizing elements is secured to each of a plurality of said digit portions.

14. The apparatus set forth in claim 10, wherein said at least one sensitizing element is secured to each of said digit portions.

15. The apparatus set forth in claim 10, wherein said at least one sensitizing element is a plurality of sensitizing elements with at least one sensitizing element secured to each of said digit portions and at least one sensitizing element secured to said palm portion.

16. The apparatus set forth in claim 10, wherein said at least one sensitizing element has a sufficient degree of rigidity and thickness to cause the hand wearing said glove to feel that the piece of sports equipment being handled is larger than it really is.

17. The apparatus set forth in claim 10, wherein said at least one sensitizing element is of sufficient rigidity and thickness to prevent the fingers and thumb of the hand wearing said glove from fully flexing around the piece of sports equipment being handled.

18. The apparatus set forth in claim 10, wherein said apparatus includes two of said gloves.

19. The apparatus set forth in claim 18, wherein each of said gloves includes an index finger portion, a thumb portion and a target marking formed along said index finger portion and said thumb portion.

20. The apparatus set forth in claim 10, wherein said at least one sensitizing element is operatively adapted for enabling each finger of the hand to be opened while wearing said glove.

* * * * *